US005697800A

United States Patent [19]

Aramizu

[11] Patent Number: 5,697,800

[45] Date of Patent: Dec. 16, 1997

[54] CONNECTOR FOR CIRCUIT BOARDS

[75] Inventor: Tatsuo Aramizu, Tokyo, Japan

[73] Assignee: NEC Corporation, Tokyo, Japan

[21] Appl. No.: 635,174

[22] Filed: Apr. 25, 1996

[30] Foreign Application Priority Data

Apr. 28, 1995 [JP] Japan ..... 7-106635

[51] Int. Cl.[6] ..... H01R 13/70

[52] U.S. Cl. ..... 439/259; 200/51 R; 439/377

[58] Field of Search ..... 439/259, 260, 439/188, 377; 200/51 R, 51.09

[56] References Cited

U.S. PATENT DOCUMENTS

| | | | |
|---|---|---|---|
| 3,344,243 | 9/1967 | De Vries | 200/51 R |
| 3,576,515 | 4/1971 | Frantz | 439/267 |
| 3,636,499 | 1/1972 | Winklebleck | 439/188 |
| 4,352,533 | 10/1982 | Murase et al. | 439/259 |
| 4,421,372 | 12/1983 | Golden | 439/260 |
| 4,470,100 | 9/1984 | Rebaudo et al. | 439/259 |
| 4,631,637 | 12/1986 | Romania et al. | 439/259 |
| 4,636,019 | 1/1987 | Gillott et al. | 439/62 |
| 4,789,352 | 12/1988 | Kreinberg et al. | 439/260 |
| 4,834,665 | 5/1989 | Kreinberg et al. | 439/260 |

*Primary Examiner*—Neil Abrams
*Attorney, Agent, or Firm*—Whitham, Curtis, Whitham & McGinn

[57] ABSTRACT

The invention provides a multi-terminal connector for connecting a circuit board to another circuit board. The connector body consists of a first body 20 having a bar-like base part 21 and an uprightly and linearly projecting part 22 and a second body 40 having a slot 42 into which the projecting part 22 of the first body 20 fits. The cross-sectional shape of the slot 42 is such that the projecting part 22 of the first body 20 fits into the slot 42. The first body 20 is to be attached to a circuit board 100 and the second body 40 to another. The first body 20 has cavities 27 at intervals in the lengthwise direction, and each cavity 27 provides openings in side faces of the projecting part 22. A shaft 24 extends through the projecting part 22 of the first body 20, and contact blades 26 are fixed to the shaft 24 in the respective cavities 27 in the first body 20. The slot 42 of the second body 40 is laterally enlarged in sections corresponding to the cavities 27 in the first body 20 to provide cross-sectionally circular spaces in the assembled two bodies to allow rotation of the contact blades 26 by turning the shaft 24. The second body 40 is coupled with the first body 40 while the contact blades 26 are kept in the vertically extending position. Connecting terminals 28A, 28B are provided in both the first 20 and second bodies 40, and each contact blade 26 makes contact with at least one terminal 28A, 28B in the first body 20 and at least one terminal 44A, 44B in the second body 40 when the blade 26 is turned to the horizontally extending position. Using this connector, a circuit board is to be slid across the other circuit board or between two other circuit boards, with each slot 42 acting as a guide for the projecting part 22 and then the shaft and attached contact blades 26 are to rotated to electrically interconnect terminals 28A, 28B on the first body to terminals 44A, 44B on the second body.

20 Claims, 8 Drawing Sheets

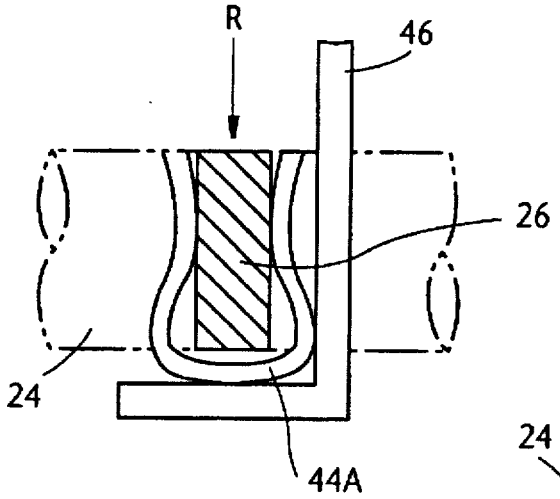
FIG. 12
FIG. 13
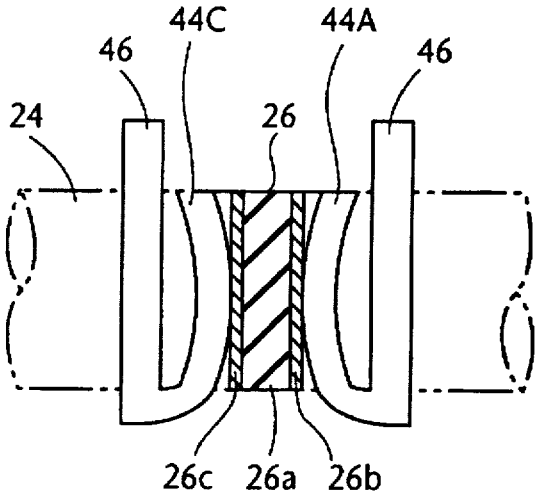
FIG. 14
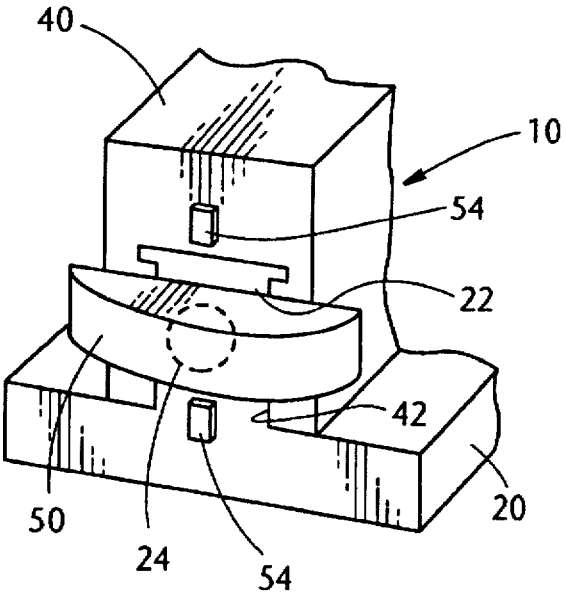
FIG. 15
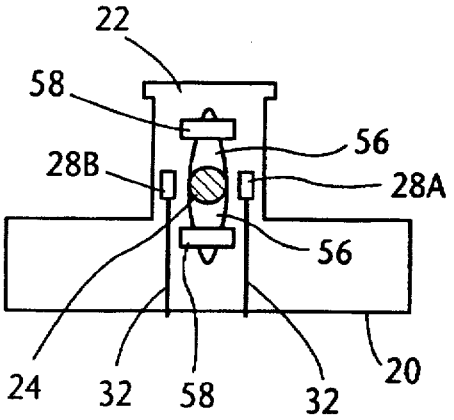

CONNECTOR FOR CIRCUIT BOARDS

BACKGROUND OF THE INVENTION

This invention relates to a connector for detachably connecting a circuit board to another circuit board both mechanically and electrically.

In computers and other electronic appliances, a circuit board is connected to another circuit board by using a bar-like connector having a number of terminals in a row or two parallel rows. In many cases the two circuit boards are connected at a right angle.

For example, as shown in FIG. 18, several circuit boards 102 are connected upright to a mother board 100 which is placed horizontally in a bottom section of a casing 105. For each circuit board 102, a multi-terminal connector 110 is attached to the surface of the mother board 100. The connector 110 has a linear slot on the upside, and on the inner walls defining the slot a number of terminals are provided in two opposite rows. Each circuit board 102 has a terminal pattern on one edge (bottom edge in FIG. 18), and the circuit board is vertically inserted into the connector until the terminal pattern on the bottom edge makes tight contact with the terminals in the connector 110. To separate the circuit board 102 from the mother board 100, the circuit board is vertically pulled up.

To move the circuit boards 102 in the vertical directions of arrow Z, an ample space is needed above the mother board 100, but in most cases it is impracticable to provide such an empty space in the casing 105. So, the attachment and detachment (particularly the latter) of the circuit boards 102 must be performed outside the casing 105.

When the conventional multi-terminal connector 110 is used, connecting terminals of each circuit board 102 can be provided along only one edge of the board. Accordingly the maximal number of connecting terminals is limited by the length of an edge of the circuit board.

If the circuit board 102 is improperly inserted into or drawn from the connector 110, the terminals of the connector might be damaged.

SUMMARY OF THE INVENTION

It is an object of the present invention to provide a connector which is useful for detachably connecting a circuit board to another circuit board and facilitates connecting two circuit boards at a right angle and, besides, makes it possible to increase the total number of connecting terminals for each circuit board.

Essentially, a connector according to the invention comprises a first body which comprises a linearly projecting part and is formed with a cavity which provides an opening in each of two opposite side faces of the projecting part; a shaft which extends through the projecting part of the first body and can be turned on its axis for changeover of an electrically disconnecting state of the connector to an electrically connecting state and vice versa; a contact blade which is fixed to the shaft to extend normal to the shaft in the cavity in the first body and is electrically conducting at least in a limited region of the surface on one side, the rotating radius of the blade being greater than a half of the width of the projecting part of the first body; a second body which is formed with a slot into which the projecting part of the first body fits, the slot being widthways enlarged in a section corresponding to the cavity in the first body to provide a space needed for rotation of the contact blade when the second body is coupled with the first body; and a first terminal which is provided on an inner wall face of the first body defining the aforementioned cavity and a second terminal which is provided on an inner wall face of the second body defining a widthways enlarged section of the slot, the first and second terminals being positioned such that a conducting region of the contact blade makes contact with both the first and second terminals when the blade is turned to a predetermined angular position.

In a multi-terminal connector embodying the invention, the above stated essential construction of the connector is supplemented with the following items.

The first body of the multi-terminal connector is an elongate body which is formed with a plurality of cavities at regular intervals in the direction of the length of the first body, and each cavity provides an opening in each of two opposite side faces of the projecting part. The shaft extends through the cavities in the first body. A plurality of contact blades are fixed to the shaft in the cavities in the first body, and the contact blades are electrically insulated from the shaft. The slot of the second body is widthways enlarged in a plurality of sections corresponding to the cavities in the first body to provide a plurality of spaces needed for rotation of the contact blades. In the first body there are a plurality of terminals each of which is provided on an inner wall face defining one of the aforementioned cavities, and in the second body there are a plurality of terminals each of which is provided on an inner wall face defining a widthways enlarged section of the slot. The first and second terminals are arranged such that a conducting region of each of the contact blades makes contact with one of the first terminals and one of the second terminals when the blades are turned to a predetermined angular position.

The first and second bodies of the connector are coupled with each other by aligning the slot of the second body with the projecting part of the first body and moving the second (or first) body in the direction of the length of the first (or second) body, and the two bodies can be separated by moving the second (or first) body in the reverse direction. In the coupling and separating operations, the contact blades are kept within the respective cavities in the first body so as not to intrude into the laterally enlarged sections of the slot of the second body. That is, in the coupling and separating operations, all the connecting terminals in the first body are kept separated from the terminals in the second body, and no part of the connector comes into contact with the terminals. Therefore, the terminals are never worn or otherwise damaged by the coupling or separating operation. This is an important advantage of a connector according to the invention.

Before coupling the first and second bodies of the connector, the first body containing the contact blades is attached to a circuit board and the second body to another circuit board.

In the case of uprightly connecting a circuit board to a mother board which is placed horizontally, the first body of the connector is attached to the surface of the mother board and the second body to the circuit board along the bottom edge of the board in the upright state. For connection, the upright circuit board is moved laterally to allow the second body of the connector to fit and slide on the first body. This is an easy operation and can be performed very smoothly. The circuit board can be detached from the mother board by an analogous operation. The connecting and detaching operations can be performed while the mother board is placed in a casing of an electronic appliance, even though there is no empty space above the height of the uprightly held circuit board, only if the casing has a suitable opening in one side face. Therefore, it is possible to enlarge the freedom of mechanical design of the casings of computers and other electronic appliances. Because of decreased restrictions on the procedures for installation of circuit boards in a casing, it is also possible to improve the constructions of such appliances to augment the ease of and convenience for the use and maintenance of the appliances.

The circuit board connected to the mother board hardly leans or sways since the projecting part of the first body of the connector fits in the slot of the second body over the full length of the connector. Therefore, the connections between the terminals in the connector do not break or loosen.

In a multi-terminal connector according to the invention the total number of connecting terminals can be considerably increased because it is possible to use each contact blade for connecting two or more pairs of terminals. Using multi-terminal connectors according to the invention it is possible to provide a greatly increased number of connecting terminals to a circuit board because two connectors can be applied to a circuit board, one along an edge of the board and the other along the opposite edge. Furthermore, it is possible to connect a circuit board to three other circuit boards by using two connectors according to the invention for two opposite edges of the first mentioned circuit board and a conventional connector for another edge of that circuit board, as will be described and illustrated hereinafter. An increase in the number of connecting terminals of a circuit board leads to an increase in the functions of the circuit board.

BRIEF DESCRIPTION OF THE DRAWINGS

FIGS. 11 and 12 show two different examples of the terminals in the connector;

FIG. 13 shows an example of the arrangement of two terminals for a contact blade in the connector;

FIG. 14 shows a knob for turning the shaft supporting the contact blades and lock parts to prevent unwanted turns, and FIG. 15 shows another example of the lock parts;

DESCRIPTION OF THE PREFERRED EMBODIMENTS

Figure 1:
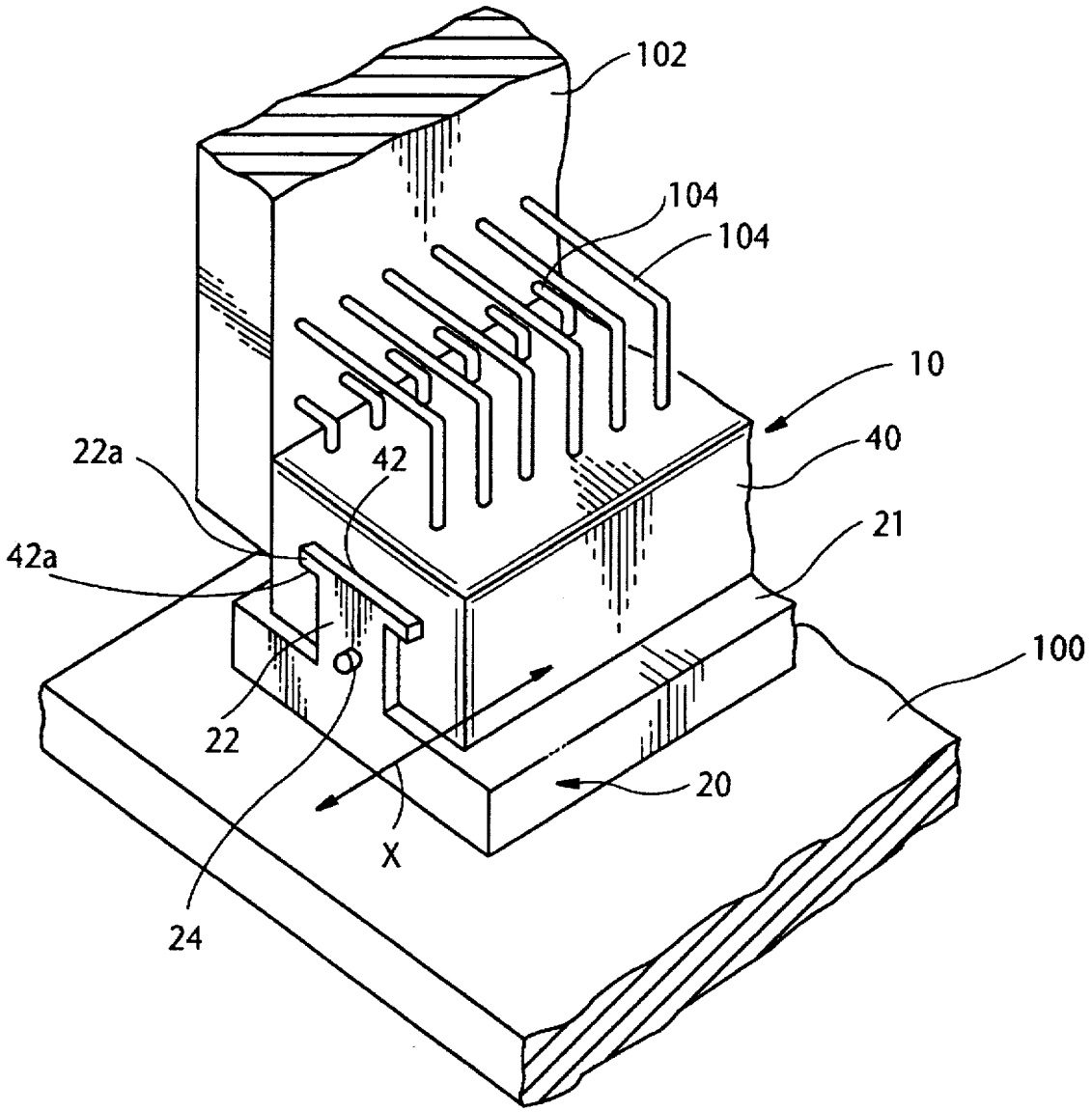
FIG. 1 is a schematic and fragmentary perspective view of a connector according to the invention used in connecting two circuit boards.

FIGS. 1 to 4 show a connector 10 embodying the invention. The body of the connector 10 is divided into two parts, first body 20 and second body 40, which can be detachably coupled with each other. These two bodies 20 and 40 are relatively elongate parts having nearly the same length. The first body 20 has a bar-like base part 21 and a projecting part 22 which is upright on the base part 21 and linearly extends over the full length of the base part 21. The projecting part 22 is rectangular in cross-section and has lateral extensions **22*a* in a top region. The second body 40 has a relatively wide slot 42 which extends linearly over the full length of the body 40 and opens in the bottom face of the bottom 40. The cross-sectional shape of the slot 42 is such that the projecting part 22 of the first body 20 fits into the slot 40. That is, the slot 42 has lateral indentations 42*a* into which the lateral extensions 22*a* of the projecting part 22 of the first body 20** fit.

In FIG. 1, the first body 20 of the connector 10 is fixed at the bottom of the base part 21 to a circuit board 100 such as a mother board for a computer, and the second body 40 is fixed at a side face to an edge region of another circuit board 102. Indicated at 104 are external wirings between the circuit board 102 and the connector 10. The circuit board 102 is attached to the circuit board 100 by holding the circuit board 102 upright, aligning the slot 42 of the second body 40 of the connector 10 with the projecting part 22 of the first body 20 and moving the upright circuit board 102 laterally in the direction of arrow X to fit and slide the second body 40 of the connector on the first body 20. To determine the final position of the second body 40, the first body 20 has stoppers 23 as illustrated in FIG. 2.

Figure 2:
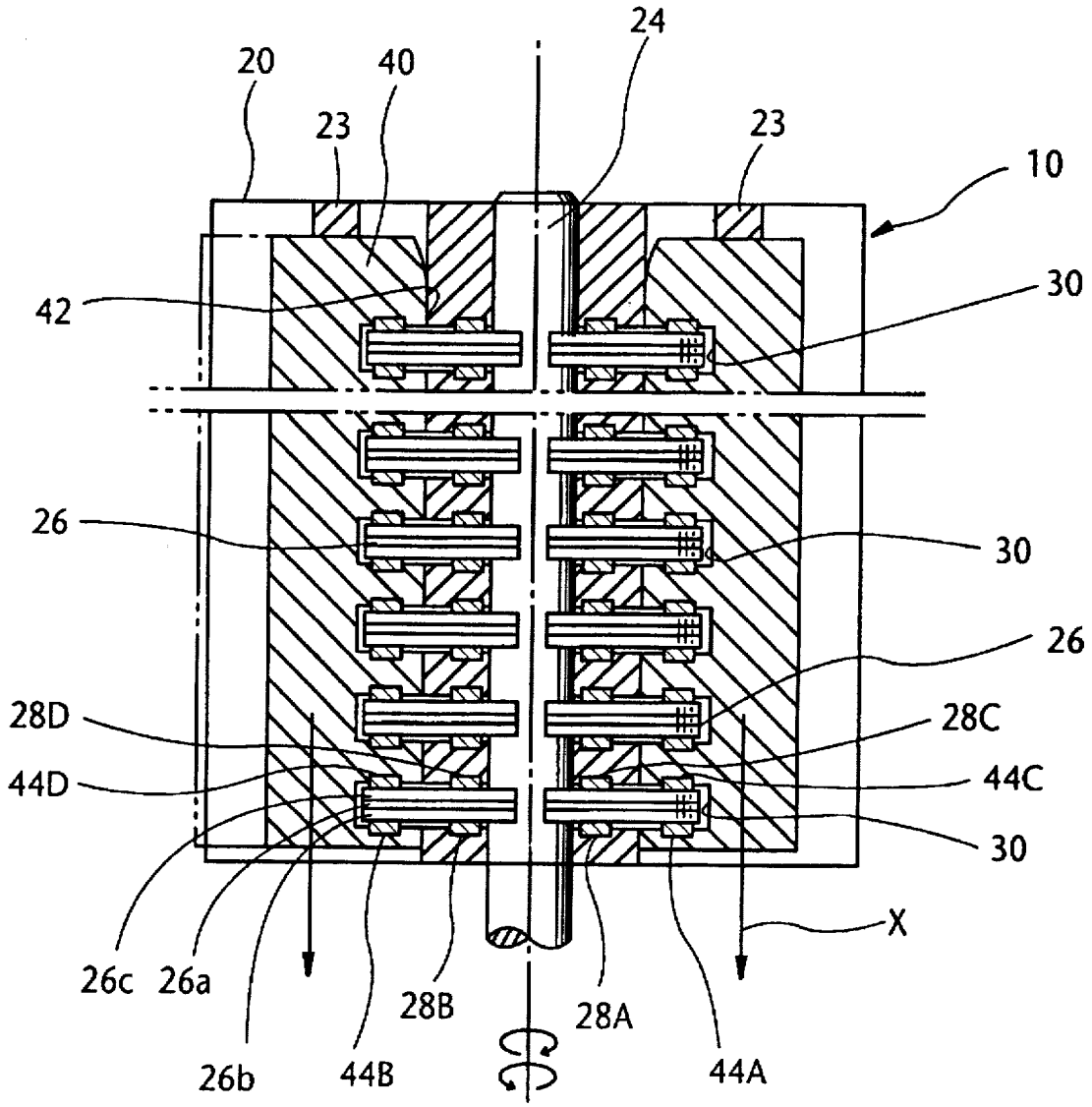
FIG. 2 is a horizontal sectional view of the connector in FIG. 1.
Figure 4:
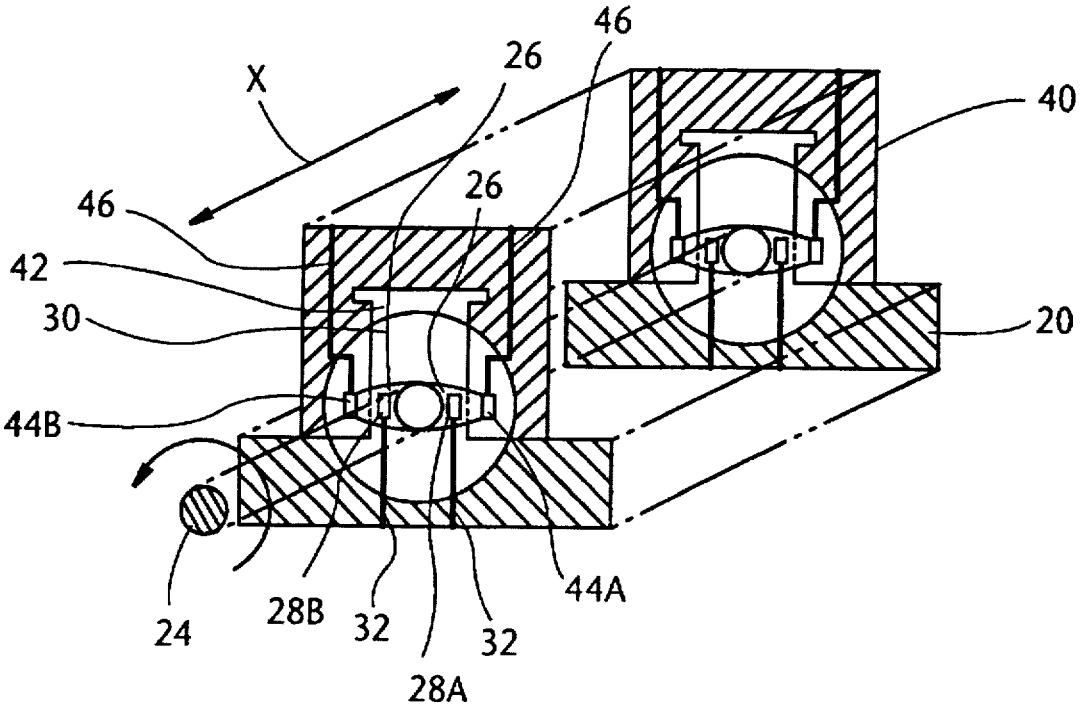
FIG. 4 is a schematic illustration of the construction of the connector.
Figure 3:
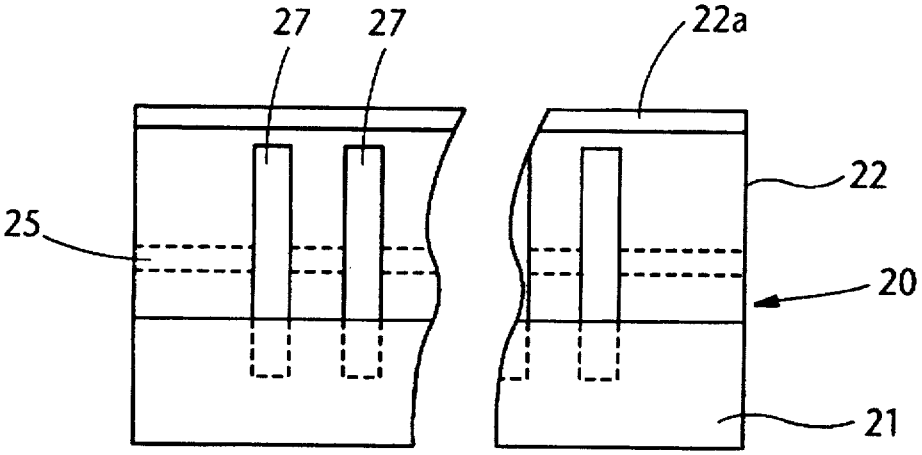
FIG. 3 is a side elevational view of a first body of the connector.

Referring to FIGS. 2 to 4, longitudinally through the projecting part 22 of the first body 20 there is a shaft 24 which can be turned on its axis. A hole 25 for the shaft 24 is indicated in FIG. 3. The shaft 24 is for changeover of an electrically disconnecting state of the connector 10 to an electrically connecting state, and vice versa. The first body 20 is partly hollowed so as to provide cross-sectionally circular cavities 27 at regular intervals in the longitudinal direction. The circular cavities 27 are coaxial with the shaft hole 25 and have a radius smaller than the height of the projecting part 22 and greater than a half of the width of the projecting part 22. So, the cavities 27 open in the two opposite side faces of the projecting part 22. In the second body 40 the slot 42 is laterally enlarged in regions corresponding to the cavities 27 in the first body 20 such that the locally enlarged slot 42 and the cavities 27 in the first body 20 provide a plurality of cross-sectionally circular spaces 30 when the second body 40 is coupled with the first body A plurality of contact blades 26 are fixed to the shaft 24 at regular intervals such that each blade 26 is received in one of the aforementioned spaces 30. All the blades 26 extend normal to the shaft 24 in the same direction or in the opposite direction. In FIG. 2 the blades 26 exist on both sides of the axis of the shaft 24, but in another case the blades 26 may exist only on one side of the shaft axis. The length of each blade 26 from the axis of the shaft 24 is longer than a half of the width of the projecting part 22 of the first body 20 and shorter than the radius of the spaces 30. In other words, the rotating radius of the blades 26 is greater than a half of the width of the projecting part 22 and smaller than the radius of the spaces 30. So, the blades 26 can be turned by turning the shaft 24. In this embodiment the contact blades 26 are electrically conducting at least in the surface. For example, as shown in FIG. 2, each contact blade 26 may have a three-layer structure consisting of an insulating core plate 26*a* and two conducting surface layers 26*b* and 26*c*. Alternatively each blade 26 may be made of a conductor plate. The blades 26 are electrically insulated from the shaft 24, so that each blade is insulated from the other blades.

For each contact blade 26, at least one connecting terminal is provided in the first body 20 on an inner wall defining the space 30, and the same number of connecting terminal(s) is provided in the second body 40 on an inner wall defining the space 30. For example, in FIG. 2, for one of the blades 26 the first body 20 has two connecting terminals 28A, 28C and the second body 40 has two connecting terminals 44A and 44C. For another (oppositely arranged) blade 26, the first body has two terminals 28B, 28D and the second body 40 has two terminals 44B, 44D. (In the following Figures the terminals 28C, 28D, 44C and 44D are omitted from illustration.) The terminals 44A, 44B, etc. in the second body 40 are located outside the side faces of the projecting part 22 of the first body 20. In the assembled connector 10, all these terminals are at nearly the same level as the shaft 24. In the first body 20, internal wirings 32 extend to the individual terminals 28A, 28B, etc., and in the second body 40 internal wirings 46 extend to the individual terminals 44A, 44B, etc. When the blades 26 are turned as will be described below, the terminals 28A, 28B, 28C, 28D in the first body 20 are connected with the terminals 44A, 44B, 44C, 44D in the second body 40, respectively. In FIG. 2 both sides of each blade 26 are used for connection of terminals, but this is merely an option. Another option is to use only one side of each blade 26.

Figure 5A:
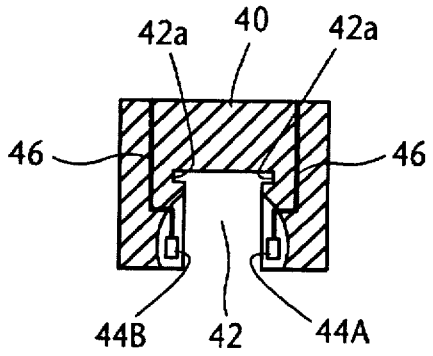
FIGS. 5(A) and 5(B) are schematic cross-sectional views of first and second bodies of the connectors.
Figure 5B:
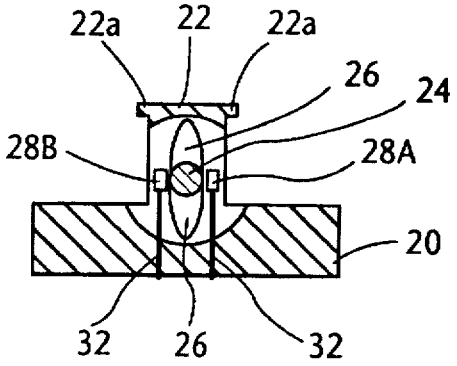
Figure 6:
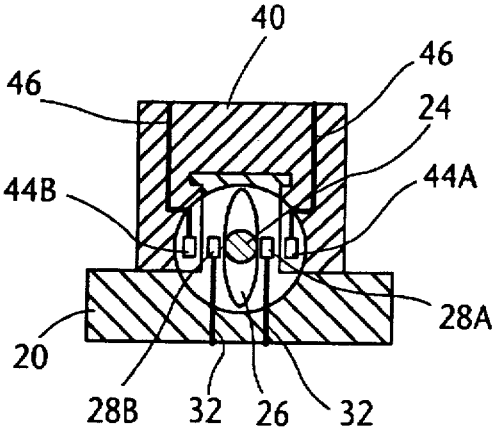
FIG. 6 shows a cross-section of the connector in the electrically disconnecting state and FIG. 7 the same cross-section in the electrically connecting state.
Figure 7:
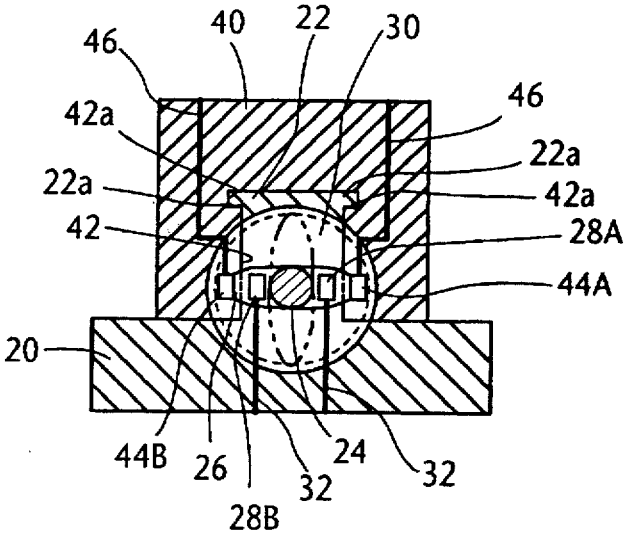
Figure 8:
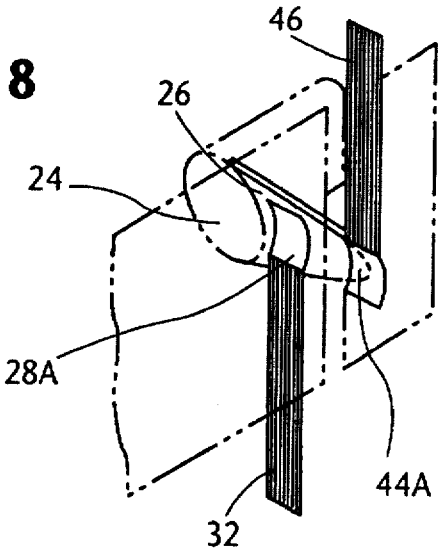
FIG. 8 illustrates the contact of a contact blade in the connector in the state of FIG. 7 with two terminals in the connector.

Referring to FIGS. 5(A), 5(B) and 6, when the second body 40 is to be coupled with the first body 20 to connect a circuit board with another circuit board, all the blades 26 in the first body 20 are directed upward or downward and isolated from the terminals 28A, 28B, etc. In that state the second body 40 is coupled with the first body 20 as shown in FIG. 6. So, the terminals 28A, 28B, etc. are not yet connected with the corresponding terminals 44A, 44B, etc. in the second body 40. After that the shaft 24 is turned by 90 degrees to turn all the blades 26 into a horizontally directed position as shown in FIG. 7 in solid line. As a result, for example, the terminals 28A and 28B in the first body 20 are connected with the terminals 44A, 44B in the second body 40, respectively. FIG. 8 shows the manner of connection between the terminal 28A and the terminal 44A. In FIG. 8 the metal plates of the terminals 28A, 44A are curved toward the surface of the blade 26 so that the terminals can make good contact with the blade 26 by a spring action. When the second body 40 is to be detached from the first body 20, the blades 26 are returned to the vertical position shown in FIG. 6.

Figure 9A:
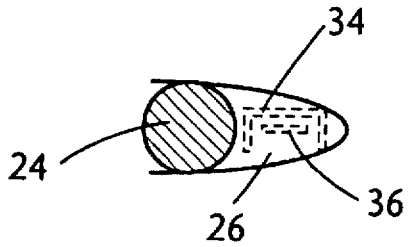
FIGS. 9(A) and 9(B) illustrate another structure of a contact blade in the connector.
Figure 10A:
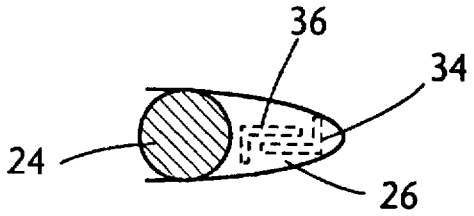
FIGS. 10(A) and 10(B) show a minor modification of the blade of FIGS. 9(A) and 9(B)
Figure 9B:
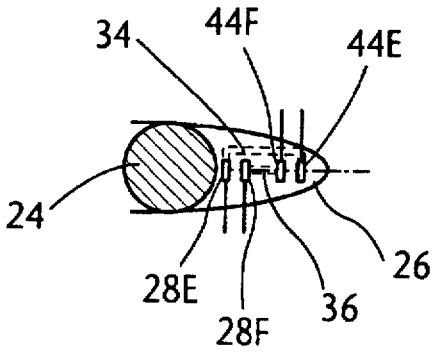
Figure 10B:
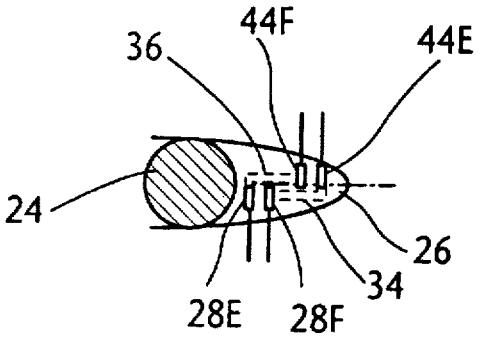

FIGS. 9(A) and 9(B) show another example of the contact blades 26. In this case each blade 26 is made of an insulating material, and two conducting path patterns 34 and 36 (or only one path pattern) are formed on one side of the blade 26. When the blade 26 in the assembled connector is turned to the horizontal position, the conducting path pattern 34 connects a terminal 28E in the first body 20 to a terminal 44E in the second body 40, while the pattern 36 connects a terminal 28F in the first body to a terminal 44F in the second body. It is possible to form two separate conducting path patterns on the opposite side of the blade 26 in order to further increase the number of electrical connections that can be made by each blade 26. FIGS. 10(A) and 10(B) show a modification of the arrangement of the 34, 36 in FIGS. 9(A) and 9(B). There is no change in principle. In FIGS. 10(A) and 10(B), the two conducting path patterns 34 and 36 have the same length. Therefore, the transmission of two electrical signals, one along the path 34 (between two terminals 28A and 44A) and the other along the path 36 (between two terminals 28B and 44A), does not affect the relationships between the two signals.

Figure 11:
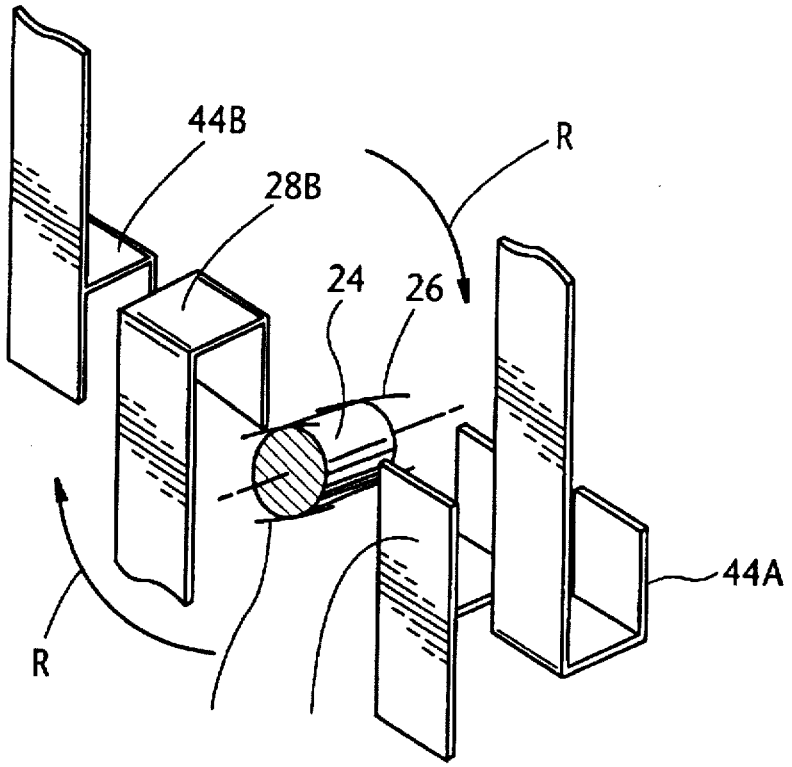

As shown in FIG. 11, the terminals 28A, 44A, etc. in the connector 10 may be angled into the form of a trough-like receptacle. When the contact blades 26 are turned (from the vertical position) in the direction of arrow R, each blade 26 is tightly received by the terminals 28A, 44A, etc. to make good contacts. Referring to FIG. 12, each terminal (e.g. 44A) in FIG. 11 may be made of a spring metal sheet with a slight modification of the trough-like shape so that the terminal 44A can securely hold the blade 26.

Referring to FIG. 13, when each blade 26 has two conducting surface layers 26*b*, 26*c* on the opposite sides of an insulating core 26*a* as illustrated in FIG. 2, two terminals (e.g. 44A and 44C) in the second body 40 or the first body 20 are arranged opposite to each other such that the blade 26 tightly intrudes into the gap between the two terminals.

To turn the shaft 24 with a screwdriver or the like, a slot may be cut in an end face of the shaft 24. FIG. 14 shows another option. A knob 50 is fixed to an end face of the shaft 24 protruding from an end face of the projecting part 22 of the first body 20. Preferably the knob 50 extends in the same direction(s) as the blades 26 attached to the shaft 24. To securely keep the knob 50 (and the blades 26 in the connector) in the vertical position, lock parts 52, 54 are provided on the end faces of the first and second bodies 20, 40 and corresponding lock parts (not shown) on the rear side of the knob 50. To securely keep the knob 50 (and the blades 26) in the horizontal position, lock parts (not shown) are provided on the end face of the second body 40 on the opposite sides of the slot 42. So, unintentional turns of the shaft 24 by external vibrations or the like are prevented.

FIG. 15 shows another method of locking the shaft 24 to keep the contact blades 26 in the vertical position. A pair of locking blades 56 are fixed to the shaft 24. The locking blades 56 are nearly similar in shape to the contact blades 26 and extend in the same directions as the contact blades 26. To keep the locking blades 56 in the vertical position, lock parts 58 are provided on an inner wall of the first body 20 (and/or the second body 40).

Figure 16:
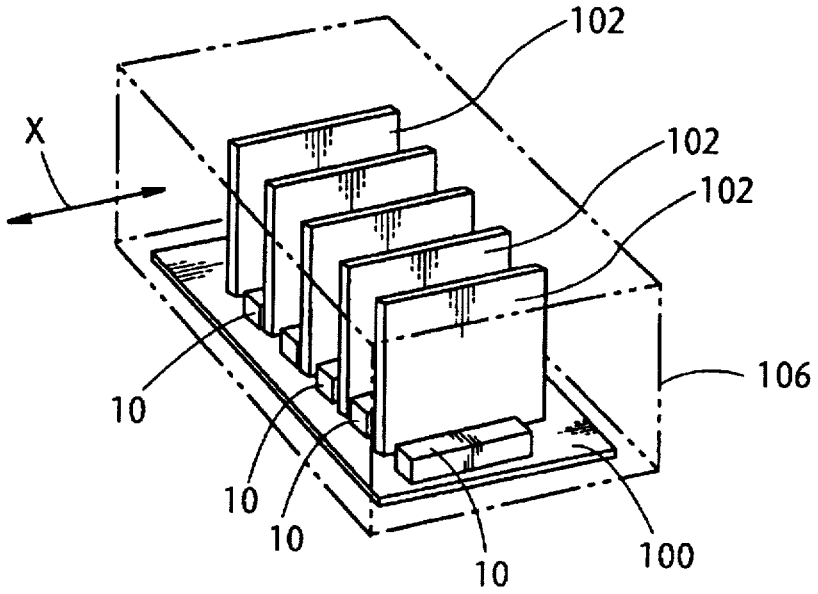
FIGS. 16 and 17 show two different ways of using connectors according to the invention for connecting circuit boards.

FIG. 16 shows the use of connectors 10 according to the invention to attach circuit boards 102 upright to a mother board 100 which is placed horizontally in a bottom section of a casing 106. For each circuit board 102, the first body 20 of the connector 10 is fixed to the surface of the mother board 100, and the second body 40 is fixed to the circuit board 102 along the lower edge of the board 102. The circuit board 102 is held in the upright state and inserted laterally (in the direction of arrow X) into the casing 106 from a side of the casing 106 in order to couple the second body 40 of the connector 10 with the first body 20 on the mother board 100. The casing 106 may have an opening on the mentioned side for the insertion and draw-out of the circuit boards 102 and a detachable cover for the opening. Then the circuit boards 102 can be inserted or drawn out even though other circuit boards or devices are installed in upper sections of the casing 106.

Figure 17:
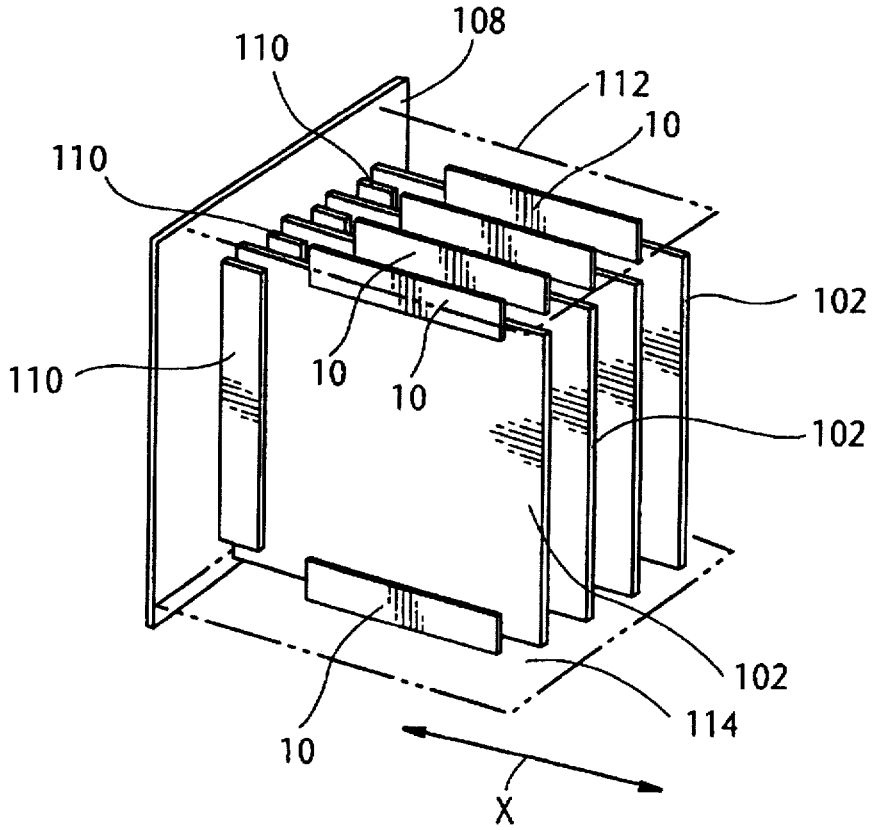
Figure 18:
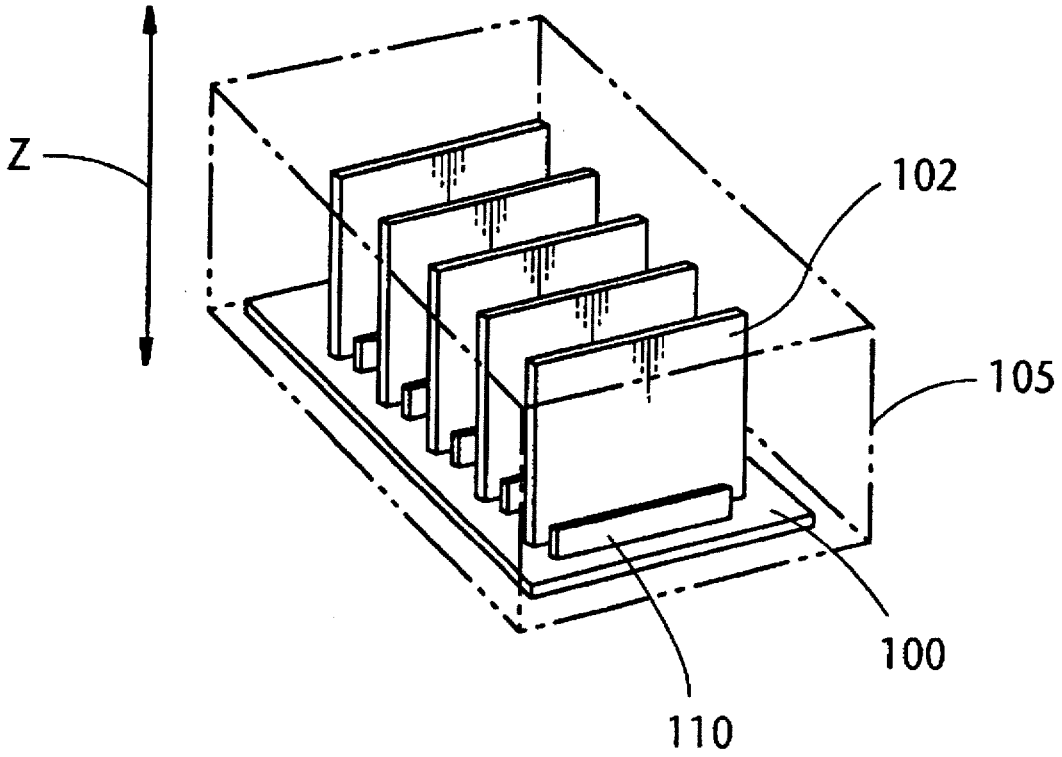
FIG. 18 PRIOR ART
FIG. 18 shows the way of connecting circuit boards by using conventional connectors.

In FIG. 17, each circuit board 102 is attached to another circuit board (e.g. back-wiring board) 108 which is kept upright and two two other circuit boards (e.g. back-wiring boards) 112 and 114 which are kept horizontal at the top and bottom levels of the back-wiring board 108. The circuit boards 102 are at a right angle with each of the three back-wiring boards 108, 112, 114. For each circuit board 102, a conventional connector 110 is attached to the upright back-wiring board 108 to extend in the vertical direction. For each circuit board 102, the first body 20 of a connector 10 of the invention is attached to the back-wiring board 112 and the first body 20 of another connector 10 to the back-wiring board 114. The second body 40 of a connector 10 is attached to each circuit board 102 along the upper edge, and the second body of another connector 10 to the same circuit board 102 along the lower edge. Each circuit board 102 is held in the upright state and inserted laterally into the space between the upper and lower back-wiring boards 112 and 114 to couple the second bodies of the two connectors 10 with the first bodies on the two back-wiring boards 112, 114, respectively. At nearly the end of the inserting operation, a side edge of the circuit board 102 comes into contact with one of the conventional connectors 110 on the back-wiring board 108. In this case each circuit board 102 has terminals on three sides. That is, when connectors according to the invention are used it is possible to greatly increase the total number of terminals of a circuit board. Accordingly it becomes possible to omit some circuits which are for decreasing the number of terminals, and consequently it becomes possible to keep transmission frequency relatively low and reduce radiation noise. A reduction in radiation noise leads to a reduction in the cost of countermeasures for radiation noise.

What is claimed is:

1. A connector, comprising:

a first body which comprises a linearly projecting part and is formed with a cavity which provides an opening in each of two opposite side faces of said projecting part;

a shaft which extends through said projecting part and said cavity of the first body and can be turned on its axis for changeover of an electrically disconnecting state of the connector to an electrically connecting state and vice versa;

a contact blade which is fixed to said shaft to extend normal to the shaft in said cavity in the first body and is electrically conducting at least in a limited region of the surface on one side, the rotating radius of said blade being greater than a half of the width of said projecting part of the first body;

a second body which is formed with a slot into which said projecting part of said first body fits, said slot being widthways enlarged in a section corresponding to said cavity in the first body to provide a space needed for rotation of said contact blade when the second body is coupled with the first body; and a first terminal which is provided on an inner wall face of the first body defining said cavity and a second terminal which is provided on an inner wall face of the second body defining a widthways enlarged section of said slot, the first and second terminals being positioned such that a conducting region of said contact blade makes contact with both the first and second terminals when said blade is turned to a predetermined angular position.

2. A connector according to claim 1, wherein said contact blade is entirely conducting.

3. A connector according to claim 1, wherein said contact blade comprises an insulating core part and at least one conducting surface layer.

4. A connector according to claim 1, wherein said contact blade comprises an insulating body and a conducting path pattern on at least one side of the insulating body.

5. A connector according to claim 1, wherein said first and second terminals are positioned on one side of said contact blade.

6. A connector according to claim 1, wherein said first and second terminals are positioned on two opposite sides of said contact blade, respectively.

7. A connector according to claim 1, wherein said predetermined angular position of said contact blade is parallel to the width of said slot of the second body.

8. A connector suitable for connecting a circuit board to another circuit board, comprising:

an elongate first body which comprises a linearly projecting part and is formed with a plurality of cavities at regular intervals in the direction of the length of the first body, each of said cavities providing an opening in each of two opposite side faces of said projecting part;

a shaft which extends through said projecting part and said cavities of the first body and can be turned on its axis for changeover of an electrically disconnecting state of the connector to an electrically connecting state and vice versa;

a plurality of contact blades which are fixed to said shaft in said plurality of cavities in the first body to extend normal to the shaft and are electrically conducting at least in a limited region of the surface on one side and is insulated from said shaft, the rotating radius of said blades being greater than a half of the width of said projecting part of the first body;

a second body which is formed with a slot into which said projecting part of the first body fits, said slot being widthways enlarged in a plurality of sections corresponding to said cavities in the first body to provide a plurality of spaces needed for rotation of said contact blades when the second body is coupled with the first body; and a plurality of first terminals each of which is provided on an inner wall face of the first body defining one of said cavities and a plurality of second terminals each of which is provided on an inner wall face of the second body defining a widthways enlarged section of said slot, the first and second terminals being arranged such that a conducting region of each of said contact blades makes contact with one of the first terminals and one of the second terminals when the contact blades are turned to a predetermined angular position.

9. A connector according to claim 8, wherein only one of said contact blades is fixed to said shaft in each of said cavities in the first body.

10. A connector according to claim 8, wherein two of said contact blades are fixed to said shaft in at least one of said cavities in the first body such that the two contact blades extend at an angle of 180° with each other.

11. A connector according to claim 8, wherein each of said contact blades is entirely conducting.

12. A connector according to claim 8, wherein each of said contact blades comprises an insulating core part and at least one conducting surface layer.

13. A connector according to claim 12, wherein each of said contact blades comprises two conducting surface layers on opposite sides of an insulating core layer, said first and second terminals being arranged such that one of the two conducting surface layers makes contact with one of the first terminals and one of the second terminals while the other conducting surface layer makes contact with another of the first terminals and another of the second terminals.

14. A connector according to claim 8, wherein each of said contact blades comprises an insulating body and a conducting path pattern on at least one side of the insulating body.

15. A connector according to claim 14, wherein each of said contact blades comprises two separate conducting path patterns on one side of the insulating body, said first and second terminals being arranged such that one of the two conducting path patterns makes contact with one of the first terminals and one of the second terminals while the other conducting path pattern makes contact with another of the first terminals and another of the second terminals.

16. A connector according to claim 8, wherein each of said first and second terminals is formed of a metal sheet so as to have a spring action when a contact blade comes into contact with the terminal.

17. A connector according to claim 8, wherein said first body comprises a bar-like base part on which said projecting part projects upright over substantially the full length of the base part, said second body comprising a bottom face which comes into sliding contact with the top face of said base part of the first body, said slot of the second body opening in said bottom face.

18. A connector according to claim 17, wherein said projecting part of the first body is rectangular in cross sections and comprises lateral extensions in a top section, said slot of the second body being laterally enlarged in a bottom section such that said lateral extensions of the projecting part of the first body fit into the laterally enlarged portions of said slot.

19. A connector according to claim 17, wherein said predetermined angular position of said contact blades is a horizontal position.

20. A connector according to claim 8, further comprising locking means for preventing unintentional turns of said shaft.

* * * * *